United States Patent [19]

Ueda

[11] 4,306,382

[45] Dec. 22, 1981

[54] GRINDING MACHINE

[75] Inventor: Minoru Ueda, Yamato, Japan

[73] Assignee: Ueda Giken Co. Ltd., Yamato, Japan

[21] Appl. No.: 136,923

[22] Filed: Apr. 3, 1980

[30] Foreign Application Priority Data

May 25, 1979 [JP] Japan ..... 54-69507[U]

[51] Int. Cl.[3] ..... B24B 5/04

[52] U.S. Cl. ..... 51/56 R; 51/289 R

[58] Field of Search ..... 51/3, 34 C, 34 E, 38, 51/40, 42, 48 R, 49 R, 50 R, 56 R, 74 R, 84 R, 95 R, 114, 123 R, 289 R; 409/203

[56] References Cited

U.S. PATENT DOCUMENTS

| | | | |
|---|---|---|---|
| 2,336,145 | 12/1943 | Wild | 51/289 R |
| 2,345,308 | 3/1944 | Wallace | 51/95 R |
| 2,693,066 | 11/1954 | Berstecher | 51/40 X |
| 2,995,874 | 8/1961 | Strickland et al. | 51/50 |
| 4,211,040 | 7/1980 | Steudten et al. | 51/42 |

*Primary Examiner*—Stephen G. Kunin
*Assistant Examiner*—Robert P. Olszewski
*Attorney, Agent, or Firm*—Holman & Stern

[57] ABSTRACT

A grinding machine in which three cup-shaped grinding wheels are disposed spaced from each other by the distance of 120° in different heights spaced from each other by a distance corresponding to one third of the feed pitch of a work to be processed to thereby ensure the removal of a substantial amount of the material from the work at one time and the precise cutting of the work.

1 Claim, 7 Drawing Figures

GRINDING MACHINE

BACKGROUND OF THE INVENTION

This invention relates to a grinding machine and more particularly, to a grinding machine in which three cup-shaped grinding wheels are disposed in different heights spaced from each other by a distance corresponding to one third of the feed pitch of the work piece to be processed. The grinder engages the work piece in three directions at right angles thereto with the center axis of each wheel deviated from the axis of the work piece by the effective radius of the wheel (the distance from the center axis of the wheel to substantially one half of the wall thickness of the cup of the wheel) so that a substantial amount of the material can be removed from the work piece at one time.

In one prior art grinding machine for cutting work pieces into cylindrical products, a single cup-shaped grinding wheel is employed and as a result, the wheel removes only a small amount of the material from the work piece at one time. Therefore, the prior art grinding machine is quite inefficient in cutting a square cross-section work-piece into a cylindrical product or cutting work pieces which are not truly circular and have a substantial margin for cutting, such as ceramic and glass wares, into true circular products.

SUMMARY OF THE INVENTION

One object of the present invention is to solve the problem inherent in the prior art grinding machine referred to hereinabove. For this purpose, according to the present invention, a work piece is supported at three points about the periphery of the work piece by three cup-shaped grinding wheels which are spaced from each other by the angular distance of 120° to thereby prevent the bending of the work piece while grinding and to ensure precise grinding of the work piece. Although only one cup-shaped grinding wheel may be employed for grinding a work piece, if the work piece is of a particular crystaline structure which has invisible small cracks therein, the work piece tends to offer resistance to cutting. In order to eliminate the difficulty, according to the present invention, the grain size of the three cup-shaped grinding wheels is so selected that the first grinding wheel performs coarse grinding, the second grinding wheel performs medium grinding and partial crack removal and the third grinding wheel performs finish grinding and final crack removal to thereby improve the grinding efficiency of the grinding machine.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

BRIEF DESCRIPTION OF THE DRAWINGS

The accompanying drawings show one preferred embodiment of the grinding machine embodying the present invention in which.

PREFERRED EMBODIMENT OF THE INVENTION

The present invention will be now described referring to the accompanying drawings which show one preferred embodiment of the grinding machine constructed in accordance with the present invention for illustration purpose only, but not for limiting the scope of the same in any way.

Figure 1:
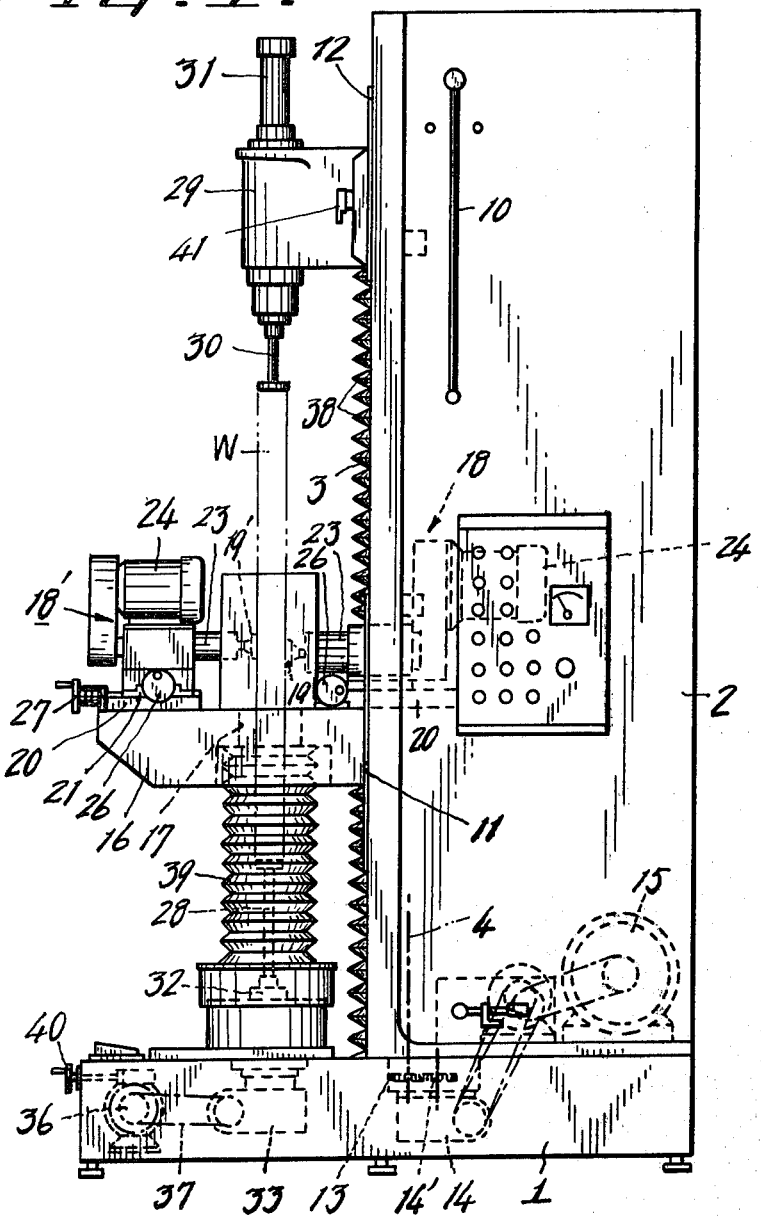
FIG. 1 is a side elevational view of said grinding machine.
Figure 2:
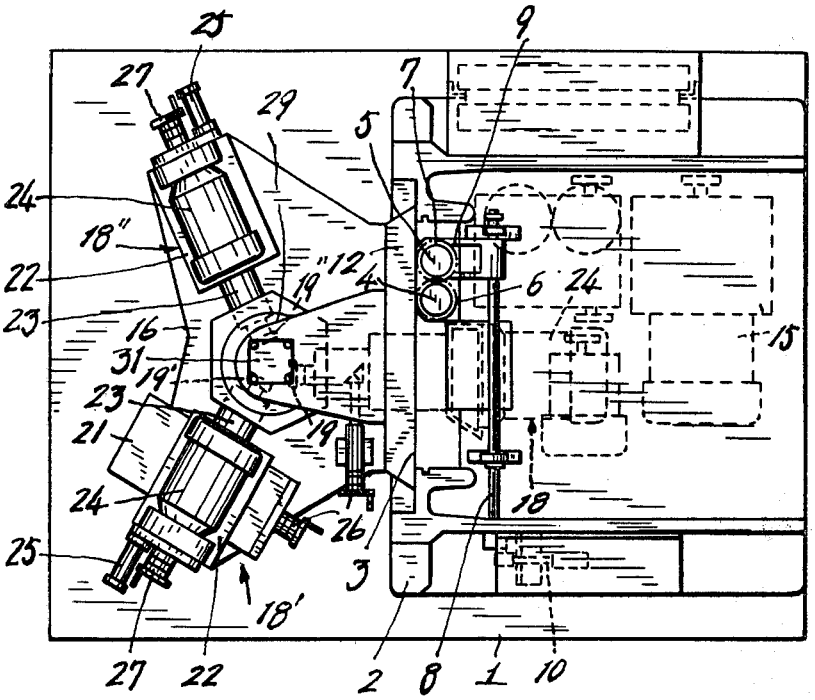
FIG. 2 is a top plan view of the grinding machine of FIG. 1.
Figure 3:
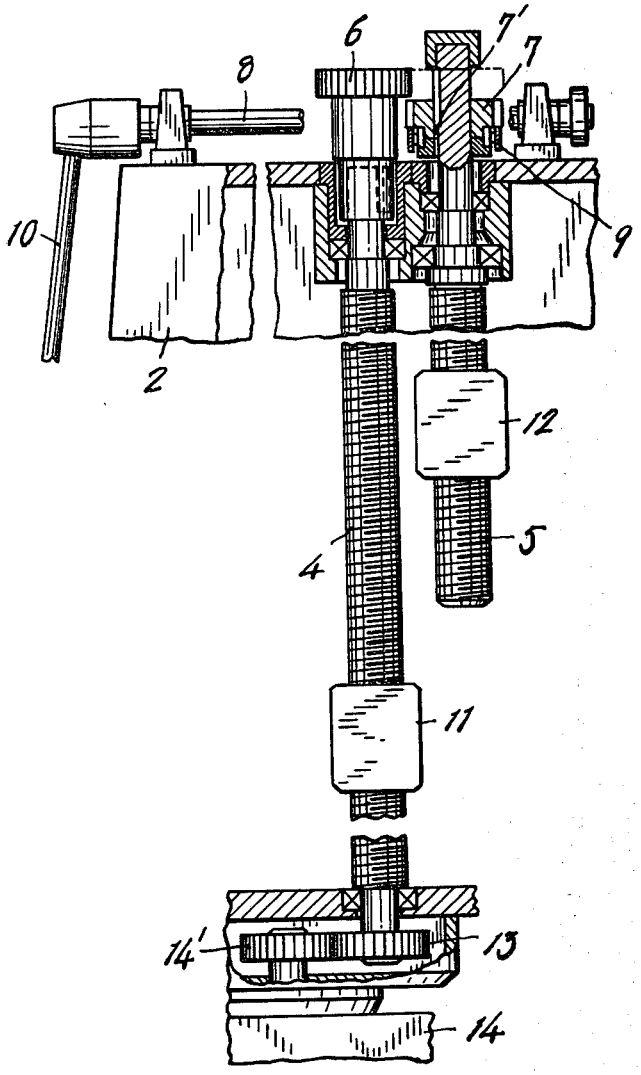
FIG. 3 is a fragmentary elevational view on an enlarged scale of the transmission mechanism for the tail stock and grinding wheel support table in the grinding machine showing a portion of the mechanism in section.

In FIGS. 1 and 2, reference numeral 1 denotes the machine base of the grinding machine and a column 2 extends uprightly from the upper surface of the base and has a slide face 3 on one surface (the inwardly directed surface as shown in FIGS. 1 and 2). The one surface of the column 2 is further provided with an opening (not shown) which extends throughout the length of the column surface for the purpose to be described hereinafter. A main rotary threaded rod 4 extends within the column 2 parallel to the slide face 3 and is journalled both at the upper and lower ends in the column 2 and the machine base 1, respectively. A rotary threaded feed rod 5 extends within the column 2 parallel to and spaced from the main rod 4 and is journalled at the upper end in the column 2 with the lower end of the rod 5 terminating short of the bottom of the column 2. The threads on the feed rod 5 have the opposite hand from that of the threads on the main rod 4. The main rod 4 has a gear 6 at the upper end and the feed rod 5 also has a gear 7 adjacent to the upper end. The gear 7 is keyed to the feed rod 5 for slidable movement along the associated rod to engage and disengage from the gear 6 on the main rod 4 and has an annular groove 7' thereabout for the purpose which is to be described hereinafter. A horizontal shaft 8 is journalled in a mid portion thereof on the top of the column 2 and has a bifurcated operation member 9 attached to one or the inner end (FIG. 3). The bifurcated operation member 9 is fitted in the annular groove 7' in the gear 7 on the feed rod 5. A clutch lever 10 (FIG. 3) is operatively connected to the other or outer end of the horizontal shaft 8 to cause the gear 7 to engage and disengage from the gear 6.

An internally threaded slider 11 is in threaded engagement with the main threaded rod 4 in a position adjacent to the lower end of the rod and projects partially out of the column 2 through the vertical opening in the above-mentioned surface of the column 2 for slidable movement along the slide face 3 on the column as the main rod 4 is rotated. Similarly, an internally threaded slider 12 is in threaded engagement with the feed rod 5 and projects partially out of the column 2 through the vertical opening in the column 2 for slidable movement along the slide face 2 as the feed rod 5 is rotated.

The main rod 4 is further provided at the lower end with a gear 13 which is in meshing engagement with a gear 14' associated with a speed reducer 14 suitably mounted on the machine base 1. Speed reducer 14 is operatively connected through a belt-shaft transmission unit to a main motor 15 (a stepless variable speed motor) which is also suitably mounted on the machine base 1.

The above-mentioned slider 11 has a grinding wheel support table 16 integrally formed therewith and extends at right angles to the vertical axis of the column 2 (in the horizontal direction) and the table 16 has a centrally disposed opening 17 through which a work piece W to be processed extends while grinding and three grinding units 18, 18', 18'' are mounted on the upper surface of the table 16 in an angularly spaced relationship by the angle of 120° about the center opening 17.

The grinding units 18, 18', 18'' comprise horizontal grinding wheel support shafts 23 which have cup-shaped grinding wheels 19, 19', 19'' mounted at the leading ends thereof, respectively.

The grinding wheel support shafts 23 are disposed in different heights so that the cup-shaped grinding wheels 19, 19', 19'' mounted on the shafts are disposed in three different heights spaced from each other by a distance corresponding to one third of the feed pitch of the work piece W with the center axis of each wheel deviated from the axis of the work piece by the effective radius of the work piece (the distance from the center axis of the wheel to substantially one half of the wall thickness of the cup of the wheel).

Each of the three grinding units 18, 18', 18'' includes a base 20 (see FIG. 1) secured to the upper surface of the table 16 and having a groove (not shown) formed in the upper surface thereof extending in the longitudinal direction of the base and a slidable platform 21 guided in the groove in the base 20 for slidable movement towards and away from the work piece W and having a dovetail projection on the upper surface thereof in a direction at right angles to the groove in the platform 21. Each grinding unit 18, 18' and 18'' also has a grinding wheel shaft support block 22 (see FIG. 2) having a dovetail groove in the undersurface thereof for receiving the dovetail projection on the slidable platform 21 so that the support block 22 moves along the dovetail projection relative to the platform 21. The support block 22 journals the grinding wheel shaft 23 of the associated grinding unit therein and includes a motor 24 for rotatably driving the shaft 23.

The slidable platform 21 of each grinding unit is operatively connected to an oil pressure-actuated cylinder 25 mounted on the base 20 and connected to a suitable oil pressure source (not shown) and the cylinder 25 is actuated to extend or retract the grinding wheel support shaft 23 and accordingly, the cup-shaped grinding wheel 19, 19' or 19'' moves towards and away from the work piece W. The movement of the block 22 in the direction perpendicular to the movement direction of the shaft 23 is regulated by manipulating a manual handle 26 which is in threaded engagement with a threaded bore in the associated block 22. In order to determine the advanced position of the associated slidable platform 21 for cutting the work piece W, a manual stop setting handle 27 is operatively connected to the platform 21.

Figure 4:
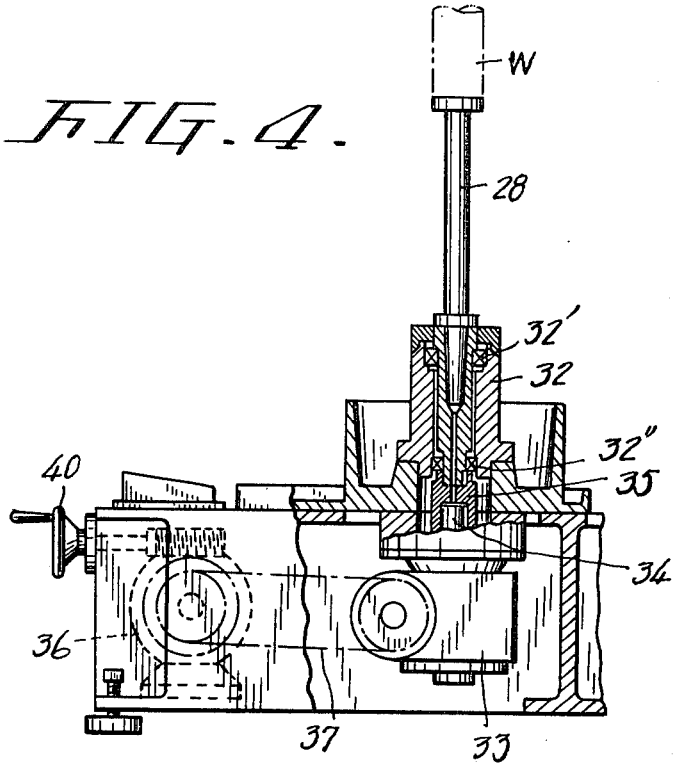
FIG. 4 is a fragmentary sectional view of the transmission mechanism for the work support rod in the grinding machine.
Figure 5:
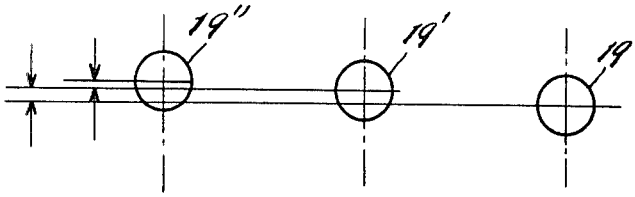
FIG. 5 is a schematic view showing the arrangement of the cup-shaped grinding wheels in the grinding machine in which the grinding wheels are positioned in different height planes.
Figure 6:
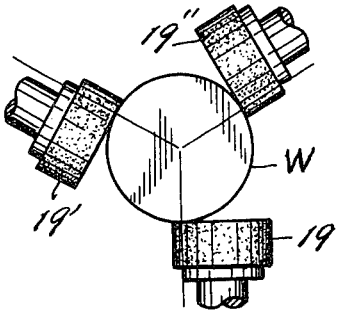
FIG. 6 is a fragmentary top plan view showing the arrangement of the cup-shaped grinding wheels spaced from each other by 120° in the grinding machine.
Figure 7:
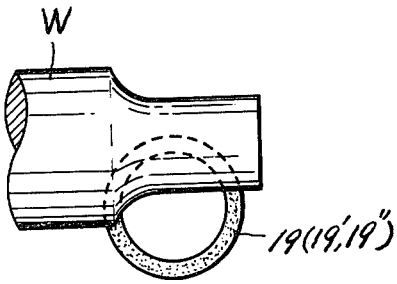
FIG. 7 is a schematic view showing the relationship of one cup-shaped grinding wheel with respect to the work to be processed during a grinding operation.

A work piece support rod 28 (see FIG. 1) is positioned just below the center opening 17 in the table 16 and the work piece holding-down rod 30 extending downwardly from a tail stock 29 which is in turn mounted on the internally threaded slider 12 aligned with the work piece support rod 29 so as to grip the work piece W in cooperation with the rod 28. The work piece holding-down rod 30 of the tail stock 29 is operatively connected to a cylinder 31 so that when the cylinder 31 is actuated to extend the work piece holding-down rod 30 downwardly towards the work piece support rod 28 to thereby grip the work piece W therebetween. The work piece support rod 28 is journaled in a position adjacent to the lower end through bearings 32', 32'' in a bearing member 32 (see FIG. 4) which is in turn suitably mounted on the machine base 1. The lower end of the work piece support rod 28 is operatively connected through a coupling 35 to the shaft 34 of a speed reducer 33 which is in turn suitably mounted on the machine base 1 (see FIG. 1) and operatively connected through a belt 37 to a stepless variable speed motor 36 which is also suitably mounted on the machine base 1. In FIG. 1, reference numeral 38 denotes a protective bellows which covers the exposed portion of the vertical opening in the above-mentioned surface of the column 2 to prevent chips from entering the interior of the column and reference numeral 39 denotes a protective bellows which prevents chips from scattering about. The changing of speed of the variable speed motor 36 is effected by rotating a manual handle 40 provided outside of the machine base 1 and operatively connected to the motor 36.

With the above-mentioned construction and arrangement of the parts of the grinding machine according to the present invention, it will be understood that prior to the start of a particular grinding operation on the work piece W, the work piece W is passed downwardly through the center opening 17 in the table 16 until the lower end of the work piece W rests on the work support rod 28, the slider 12 is slid down along the slide face 3 on the column 2 until the work piece holding-down rod 30 abuts against the upper end of the work piece W to grip the work piece W between the rods 28, and 30. The grinding wheel support shafts 23 are advanced until the cup-shaped grinding wheels 19, 19', 19'' abut against the periphery of the work W. The main motor 15 is energized for the purpose to rotate the main threaded rod 4 through a belt, the speed reducer 14 and the gears 14' and 13 so as to upwardly move the slider 11 and accordingly, the table 16 integral with the slider 11 towards the work holding-down rod 30. Such upward movement of the table 16 is allowed by the movement of the slider 11 in threaded engagement with the main rod 4 along the rod as the latter is rotated. Then, the clutch lever 10 is operated to cause the gear 7 on the feed rod 5 to engage the gear 6 on the main rod 4 to thereby cause the main rod 4 and feed rod 5 to engage each other. By the engagement between the main rod 4 and feed rod 5, the rotating rod 4 rotates the rod 5 so as to move the slider 11 downwardly relative to the rotating feed rod 5 along the slide face 3 on the column 2 by a distance depending upon the length of a particular work piece W. As the slider 12 moves downwardly along the feed rod 5, the tail stock 29 mounted on the slider 12 also moves downwardly. When the work piece holding-down rod 30 reaches a predetermined position which also varies depending upon the length of the work piece W, the motor 15 is deenergized and the slider and tail stock assembly 12, 29 is clamped to the column 2 by means of a bolt 40 and held in place. Thereafter, the clutch lever 10 is again operated so as to disengage the gear 7 from the gear 6 which in turn disengages the feed rod 5 from the main rod 4. After this, the work piece W is passed through the center opening 17 in the table 16 until the lower end of the work piece W rests on the work support rod 28 and the cylinder 31 is then actuated so as to advance or move the work piece holding-down rod 30 towards the work piece W until the rod 30 grip the work piece W in cooperation with the rod 28. After the work piece W has been gripped by the rods 28 and 30 in the manner mentioned above, the platforms 21 associated with the three grinding units 18, 18' and 18" are moved towards the work piece W along their respective bases 20 by the operation of the oil pressure-operated cylinders 25. The forward movement distance of the platforms 21 is determined depending upon predetermined cutting amounts of the work piece W, that is, 5 mm–20 mm for coarse cutting, 0.5 mm–2 mm for medium cutting and 0.2 mm–0.5 mm for fine or finish cutting, for example. After the platforms 21 have been advanced to the positions for proper cutting, the cylinders 24 associated with the three grinding units 18, 18', 18" are actuated to rotate the shafts 23 and accordingly, the cup-shaped grinding wheels 19, 19', 19" mounted thereon and at the same time. Thereafter motor 15 is again actuated to rotate the main shaft 4 and the motor 36 is actuated to rotate the work piece support rod 28 and accordingly, the work piece W thereon. The rotation of the main rod 4 causes the slider 11 and accordingly, the table 16 integral with the slider 11 to move gradually and upwardly relative to the column 2 to thereby perform cutting on successive sections of the work piece W. During the cutting operation, the cup-shaped grinding wheels 19, 19', 19" abut against the periphery of the work piece W and support the work piece W in the three directions about the work piece and when the work piece W has been completely ground to a desired or predetermined finish diameter, the grinding wheels cease their supporting action for the work piece W and the motor 15 is deenergized to stop the movement of the slider and table assembly 11, 16. As mentioned hereinabove, since the cup-shaped grinding wheels 19, 19', 19" are disposed in different heights spaced from each other by a distance corresponding to one third of the feed pitch of the work piece W with the center axis of each wheel deviated from the axis of the work by the effective radius of the wheel, the grinding wheel 18 performs the coarse cutting, the grinding wheel 18' performs the medium cutting and partial removal of cracks and the grinding wheel 18" performs the final or fine grinding and final removal of cracks, respectively.

As clear from the foregoing description on one preferred embodiment of the grinding machine according to the present invention, since the work piece W is supported at three points on the periphery of the work during the cutting operation, any bending of the work which may otherwise occur can be effectively prevented to thereby ensure precise grinding. And since the three cup-shaped grinding wheels cut the work at three different heights spaced from each other by a distance corresponding to one third of the feed pitch of the work with the center axis of each wheel deviated from the axis of the work by the effective radius of the work, the coarse, medium and finish crack removal cutting operations are smoothly and in succession performed on the work to thereby ensure efficient cutting and prevent occurrence of cracks in the work due to resistance of the work against cutting.

While only one embodiment of the invention has been shown and described in detail, it will be understood that the same is for illustration purpose only and not to be taken as a defition of the invention, reference being had for this purpose to the appended claim.

What is claimed is:

1. A grinding machine comprising: a machine base; a column extending uprightly from said machine base and having a vertical slide face on one surface and a vertical opening in said one surface adjacent to said slide face; a vertical rotary main threaded rod extending within said column parallel to said slide face and journaled at the upper and lower ends in said column, said main threaded rod having a gear mounted thereon; a vertical rotary threaded feed rod extending within said column in parallel to said main threaded rod and having the thread hand opposite from that of said main threaded rod, said feed rod having a gear mounted thereon for engaging and disengaging from said gear on the main threaded rod; a clutch operatively connected to said main and feed rods for causing said gear on the feed rod to engage said gear on said main rod so as to transmit rotation between the two rods and disengage the gears from each other; an internally threaded first lower slider in threaded engagement with said main threaded rod for movement along the rod in slidable contact with said slide face and partially projecting out of said vertical opening; a second upper internally threaded slider in threaded engagement with said feed rod for movement along the rod in slidable contact with said slide face and partially projecting out of said vertical opening; a grinding wheel support table integrally mounted on said first slider and having a center through opening for receiving a work to be processed; three grinding wheel bases mounted on said table angularly spaced from each other by an angle of approximately 120°; a tail stock integrally mounted on said second slider above said center opening and having a cylinder-operated work piece holding-down rod extending downwardly from the tail stock; a motor-driven rotary work piece support rod journaled in said machine base in a position below said center opening in alignment with said work piece holding-down rod for gripping said work piece in cooperation with the work piece holding-down rod; and grinding wheel support shafts mounted on said grinding wheel bases and supporting cup-shaped grinding wheels at the leading ends, said grinding wheel bases being so provided that said cup-shaped grinding wheels are disposed in three different heights spaced from each other by a distance corresponding to one third of the feed pitch of said work piece with the center axis of each wheel deviated from the axis of the work piece by the effective radius of the wheel.

* * * * *